United States Patent [19]

Cinotti

[11] Patent Number: 4,735,601

[45] Date of Patent: Apr. 5, 1988

[54] DEVICE SERVING TO FASHION CARRYING HANDLES FOR ATTACHMENT TO SHEET WRAPPING MATERIAL

[75] Inventor: Andrea Cinotti, Bologna, Italy

[73] Assignee: Wrapmatic S.p.A., Bologna, Italy

[21] Appl. No.: 43,101

[22] Filed: Apr. 27, 1987

[30] Foreign Application Priority Data

May 2, 1986 [IT] Italy ..... 3408 A/86

[51] Int. Cl.[4] ..... B65B 61/14

[52] U.S. Cl. ..... 493/88; 53/134; 493/345; 493/357; 493/909; 493/926

[58] Field of Search ..... 53/134, 413; 493/88, 493/226, 909, 926, 345, 357, 356

[56] References Cited

U.S. PATENT DOCUMENTS

| | | | |
|---|---|---|---|
| 2,554,004 | 5/1951 | Bergstein | 493/88 |
| 2,766,567 | 10/1956 | Fahrenbach et al. | 53/413 X |
| 2,877,613 | 3/1959 | Shuttleworth et al. | 53/134 X |
| 2,988,967 | 6/1961 | Dudnick et al. | 493/88 |

FOREIGN PATENT DOCUMENTS

| | | | |
|---|---|---|---|
| 1417716 | 12/1975 | United Kingdom | 53/413 |

*Primary Examiner*—James F. Coan

*Attorney, Agent, or Firm*—Laff, Whitesel, Conte & Saret

[57] ABSTRACT

In a device according to the invention, a roll of relatively narrow strip is unwound, measured into discrete lengths in which two C-shaped incisions are punched, then indexed through a cutting station and conveyed forward singly above the level of the sheet of wrapping film, at right angles to the direction in which it is run through the machine. The two ends of each discrete strip are picked up by suckers that draw together through a plane parallel with the path through which the strip is conveyed, while the strip itself is lifted from the middle; the strip is thus made to assume an upturned 'T' profile, with the two incisions sandwiched together, before being offered and heat-sealed to the sheet film from which single wrappings are ultimately formed.

12 Claims, 2 Drawing Sheets

DEVICE SERVING TO FASHION CARRYING HANDLES FOR ATTACHMENT TO SHEET WRAPPING MATERIAL

BACKGROUND OF THE INVENTION

The invention relates to a device serving to fashion carrying handles for attachment to a sheet of wrapping film.

The prior art embraces numerous machines that are able to produce a wrapping, with handles, such as will envelop a product to be packaged. Certain of these machines fashion the handles in the finished package, for example, by double-folding and punching hand holes through the wrapping material; however, a considerable waste of material is involved with such methods, packages of a certain length are not always easy to carry, and most significant, the machine can not readily be adapted to turn out different sizes of wrapping.

Prior art methods of fashioning the handles for such wrappings currently follow one of two distinct directions, the difference between which consists substantially in the moment at which the handle is attached to the wrapping film. In a first method, the handle is applied to a wrapping which already envelops the packaged product, whereas in a second method, developed by the same applicant, a piece of material constituting the handle is applied to the film before the product is wrapped.

Departing from this second method, which is able to avoid damage to the product occasioned by application of the handle and permits of adapting the machine for different sizes of wrapping in extremely simple fashion, the applicant now seeks to overcome a drawback relating to the thickness of the wrapping materials utilized, namely, the bulk sheet, or film, and the strip material used to fashion the handle.

A tendency exists, dictated by cost, to limit the thickness both of the film and of the handle strip as far as possible, with the result that the finished wrapping does not always afford sufficient strength when the package is suspended and carried by its handle.

Practical experiment has shown that the film tends to break, not at the point where the handle is joined (heat-sealed in the majority of instances), but in the area immediately surrounding the join.

Accordingly, the object of the invention is to overcome this drawback and thus permit of utilizing film of limited thickness in the interests of cost-effective manufacture.

SUMMARY OF THE INVENTION

The stated object is achieved by adoption of a device as disclosed and claimed herein.

A device according to the invention is able to punch pairs of C-shaped incisions face to face in the bulk strip used to form the carrying handles, then to pick up discrete lengths of the strip one by one, each exhibiting one such pair of incisions, and draw the ends together in such a way that the single strip assumes an upturned-T profile, with the two incisions sandwiched together and directed upwards, prior to its attachment to the wrapping film.

The invention provides significant advantages; in particular, the heat-sealed area of the carrying handle is significantly large, so that mechanical stress is spread over a generous area and there are no problems regarding the ability of the wrapping film to withstand the strain.

BRIEF DESCRIPTION OF THE DRAWINGS

The invention will now be described in detail, by way of example, with the aid of the accompanying drawings, in which.

DESCRIPTION OF THE PREFERRED EMBODIMENT

Figure 1:
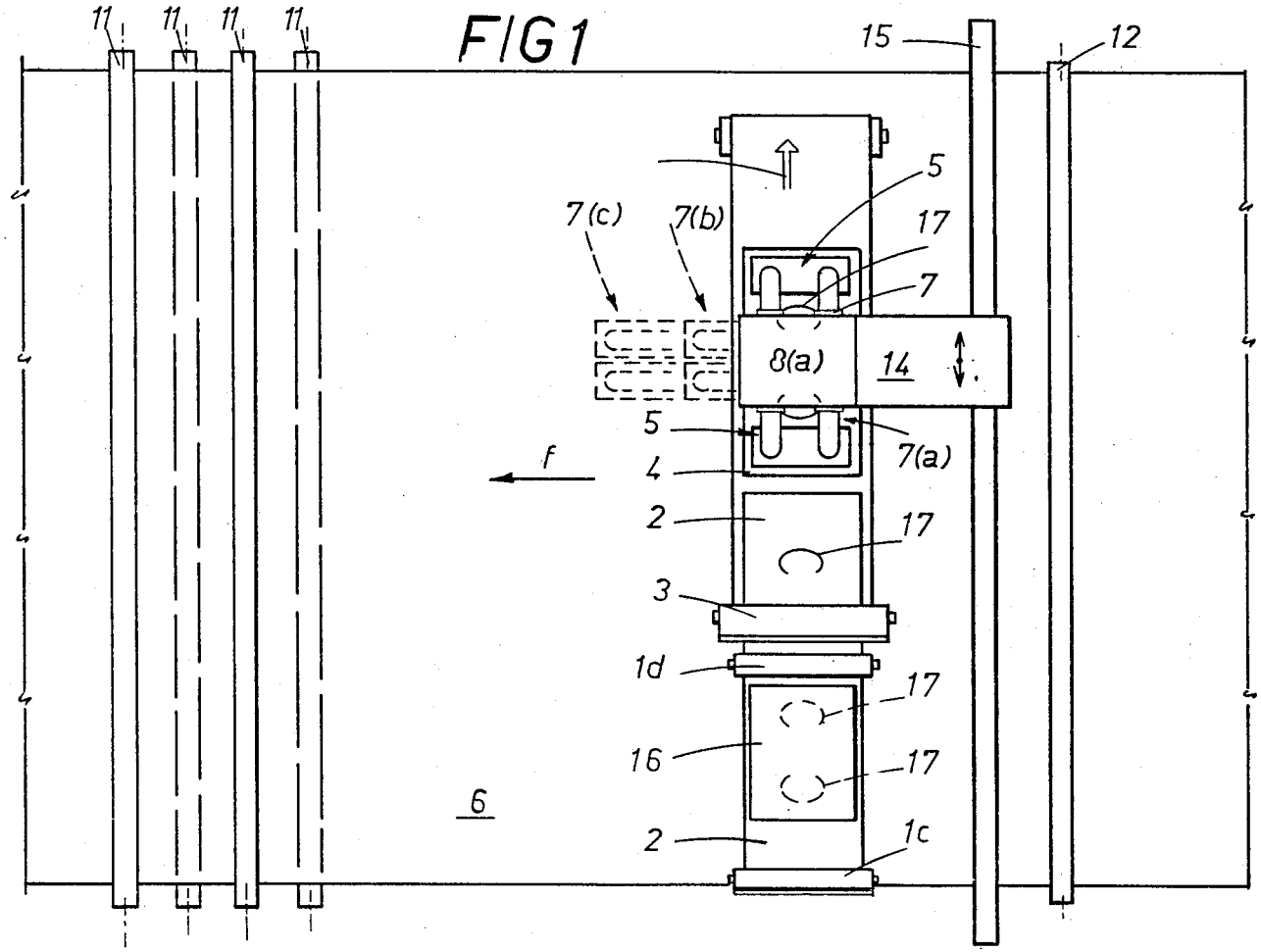
FIG. 1 is a schematic representation of the device according to the invention, viewed in plan and with certain parts omitted better to reveal others, which also shows components of the machine into which the device itself is integrated.

In FIG. 1 of the drawings, 10 denotes a device by which carrying handles are fashioned in readiness for attachment to a sheet of wrapping film 6 (heat-sealable material in most instances) that ultimately will envelop a product. The device 10 is integrated into a conventional wrapping machine of which the essential parts only are shown, in the interests of clarity, namely, a set of freely revolving parallel rollers 11, and two bars 12 lying parallel with the rollers and vertically aligned one with the other. The freely revolving rollers 11 are set apart at a given distance one from the next, and journalled to flexible supports (conventional, and therefore not illustrated), in such a way as to enable their drawing together as the film 6, which follows a zig-zag course through the rollers, is subjected to greater tension. Rollers thus arranged therefore function as dancers, as a person skilled in the art will be aware. The two parallel bars 12 are located one above and one below the running film 6, and can be drawn together to the point of gripping the film and halting its progress. The bars 12 are located upstream of the rollers 11 in such a way that, when gripping and restraining the film 6, the rollers 11 will draw together and thus enable continuous feed to the downstream stations of the machine for the duration of bars' operating cycle.

The device 10 comprises infeed means 1 the purpose of which is to supply bulk strip 2, of width less than that of the wrapping film 6, and cutting means 3 that sever the bulk strip into discrete strips 4 of a given length.

Figure 2:
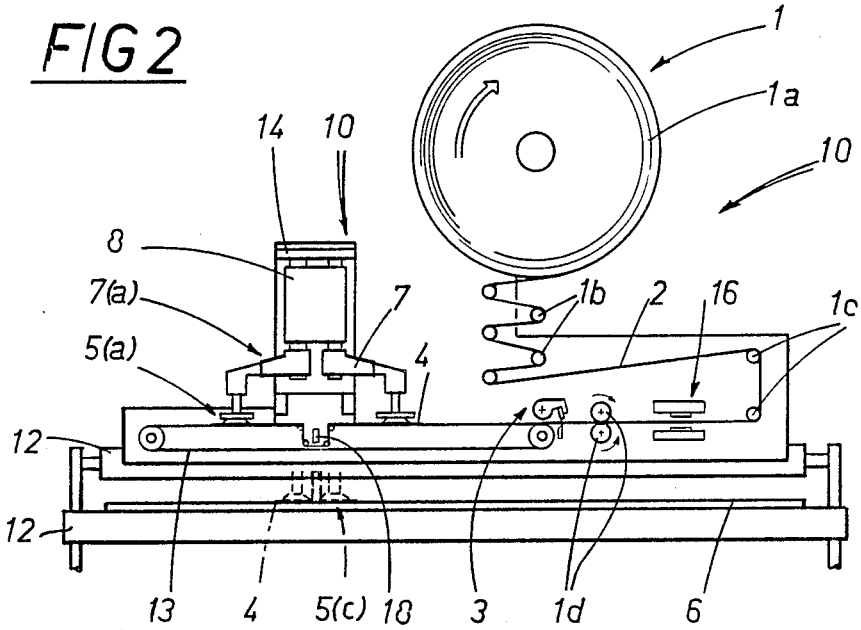
FIG. 2 is a front elevation of the device illustrated in FIG. 1.

The infeed means 1 will be seen, in FIG. 2, to comprise a roll 1*a* of bulk strip 2, a set of dancing rollers 1*b*, a set of intermediate rollers 1*c* and a pair of pinch rollers 1*d* by which the strip is fed into the cutting means 3. The pinch rollers 1*d* will be driven intermittently for a duration commensurate with the length of the discrete strip 4, operating synchronously with the systems that feed and handle the wrapping film 6.

According to the invention, the device 10 is provided with means 13 for supporting and feeding the discrete strips 4, located downstream of the cutting means, punching means 16, and means 5 for retaining the strips carried by the support and feed means 13.

The support and feed means 13, which might be embodied as a conveyor belt, are located above the film 6 and disposed at right angles to the direction in which it is fed, denoted f in FIG. 1.

In a preferred embodiment, the punching means 16 will be located between the intermediate rollers 1*c* and the pinch rollers 1*d*, and serve to pierce the strip with two incisions 17, disposed face to face and exhibiting preferably a C outline, or any shape that will minimize the probability of a tear opening up in the finished handle when in use. Operation of the cutting means 3 will be programmed so that each successive discrete strip 4 exhibits one centrally aligned pair of incisions 17.

In the example illustrated, retention means 5 are embodied as two aligned sets of suckers carried by the projecting ends of two pairs of hinged arms 7 the remaining ends of which are pivotably attached to positioning means 8, for example a slide disposed at right angles to the belt 13.

The pairs of arms 7 are anchored to the two longitudinal sides of the slide 8, and are rotatable about respective vertical axes between a first limit position, in which they are aligned and parallel with the belt 13 (see bold outline in FIG. 1, denoted 7*a*), and a second limit position in which they are disposed substantially at right angles to the belt 13 with the suckers 5 drawn as close together as is permitted (see broken line in FIG. 1, denoted 7*b* and 7*c*). In effect, each pair of arms 7 together with its relative set of suckers 5 constitute the moving components of an articulated parallelogram of which the slide 8 is the fixed component.

The sets of suckers 5 are capable of vertical movement between a raised position, in which they lie marginally above the level of the belt 13 (see bold outline in FIG. 2, denoted 5*a*), and a lowered position in which they hold the discrete strip 4 in contact with the wrapping film 6 (see broken line in FIG. 2, denoted 5*c*).

In the embodiment shown in the drawings, which is illustrated by way of example, vertical movement of the suckers 5 is obtained by enabling movement of the arms 7 along their respective axes of rotation; for faster positioning of the suckers 5, linear and rotary movement of the arms 7 along and about their axes of rotation would be effected simultaneously.

In a preferred embodiment, the arms 7 will be adjustable for length, embodied telescopically for example, as in FIGS. 1 and 2, to permit of adapting to the length of the discrete strip 4.

The slide 8 is capable of axial movement, and carried by a movable structure 14 that traverses along at least one rail 15 spanning the width of the film 6, thereby enabling transverse positioning of the slide 8, hence of the suckers 5, in relation to the film. The slide 8 can be moved between two limit positions: retracted (bold outline, FIG. 1), in which the axes of rotation of the arms 7 are vertically aligned with the belt 13; and extended, with the axes of rotation lying outside the area occupied by the belt 13, and the arms occupying the position denoted 7*a*.

It will be observed in FIG. 2 that the belt 13 exhibits a downward kink coinciding with the median axis separating the two sets of suckers 5, serving to accommodate a movable fold former 18 that might be embodied as a dull blade. Such a blade, operated by conventional means not shown in the drawings, is capable of movement between a lowered position, in which it lies below the level of the top stretch of the conveyor belt 13 so that progress of a discrete strip 4 along the belt is unimpeded, and a raised position in which it lies between the two sets of suckers 5 when drawn together; ascent of the blade 18 and inward movement of the suckers 5 will be effected simultaneously.

The device thus embodied will also comprise means, such as a source of pneumatic suction (not illustrated), which connects with the two sets of suckers 5 and operates them synchronously with the movements of the wrapping machine as a whole.

Operation of the device according to the invention will now be described, departing from the configuration illustrated by the bold outline of FIGS. 1 and 2, in which the arms 7 are aligned (7*a* in FIG. 1), the suckers raised (5*a*, FIG. 2), the slide 8 in retracted position (8*a*, FIG. 1), and the bars 12 separated one from the other.

During the time taken for the arms 7 and the slide 8 to reach the 'a' configuration, the pinch rollers 1*d* will have fed in a length of strip 2 from which the cutting means 3 in their turn will have severed a discrete length 4, exhibiting two C-shaped incisions 17, to be conveyed forward by the belt 13 to a point beneath the suckers 5. The suckers 5 now connect with suction, and duly pick up the two ends of the discrete strip 4, whereupon the arms 7 are rotated into the parallel position denoted 7*b*, and the blade 18 is raised. This movement of the arms 7 causes the suckers 5 to draw the two ends of the strip 4 together, while the rising blade 18 lifts the central part, producing a fold along the median axis between the two incisions 17. Accordingly, the discrete strip 4 gradually assumes an upturned 'T' profile. Concurrently with this folding step, the punching means 16 will operate so as to produce two further incisions in the next stretch of strip 2, ultimately to be cut into a discrete length 4.

The slide 8 is now moved into its extended position and the suckers 5 are lowered until the discrete strip 4 is brought into contact with the film 6 (position 5*c* in FIG. 2). The machine will incorporate conventional heat-sealing means (not illustrated) installed below the level of the film 6, against which the film itself and the two ends of the strip 4 are pressed by the descending suckers 5 to produce a join. Before the two ends 34 actually make contact with the wrapping film 6, the bars 12 will come together and grip the film, preventing it from moving forward; the dancers 11 are drawn closer together in response to increased tension on the film, which continues to be carried forward in spite of the momentary restraint. With the heat-sealing operation accomplished, the arms 7 and the slide 8 are returned to the at-rest positions denoted 7*a* and 8*a* in FIGS. 1 and 2.

The wrapping film 6 thus exits from the device with discrete punched and folded strips 4, carrying handles in effect, attached at regular intervals.

Figure 3:
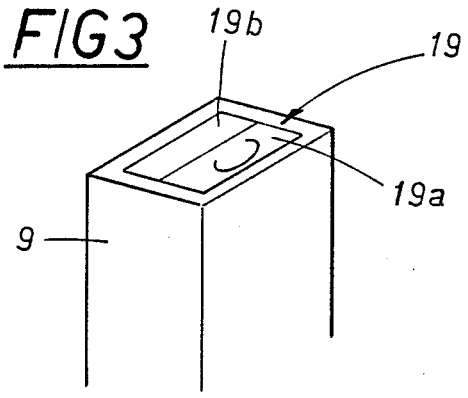
FIG. 3 shows a wrapping with the handle according to the invention, viewed in perspective.
Figure 4:
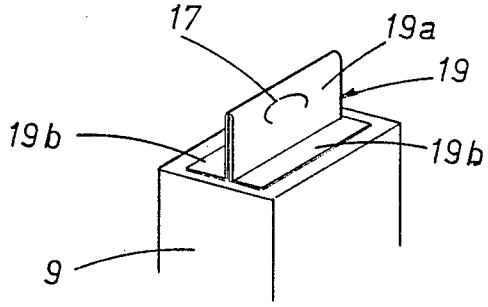
FIG. 4 is the perspective of the wrapping in FIG. 3, seen with the handle in the carrying position.

The packaged end product appears ultimately with a wrapping 9 as in FIG. 3. The handle 19 will be seen to be attached to one side of the wrapping 9 by its horizontal flaps 19*b* with the upright leg 19*a* of the upturned 'T' folded down flat. This same upright leg 19*a* (see FIGS. 3 and 4) exhibits an upward facing C-shaped incision formed by sandwiching together the two single incisions 17 cut in the discrete strip 4. With the packages stacked for transportation and warehousing, the handle 19 remains fully in contact with the wrapping 9, whereas for carrying purposes, it will be rotated about the axis of the conjunction between the vertical leg 19*a* and the two horizontal flaps 19*b* so as to separate from the contour of the package and afford a grip, as in FIG. 4.

The device illustrated in the drawings is by no means definitive. The option exists, for example, of producing vertical movement of the suckers 5 by embodying the movable structure 14 such as to raise and lower the slide 8, or embodying the suckers 5 in such a way as to move in relation to the arms 7. Similarly, the arms 7 might be fitted to the slide 8 in such a way that the distance separating their axes of rotation can be adjusted according to the dimensions of the wrapping. Again, the two sets of suckers 5 might be attached to the slide 8 without using the arms 7, yet capable of drawing together and spreading apart longitudinally, considered in relation to the belt 13. The option also exists of positioning the blade 18 to one side of the belt 13, in the path of the oncoming arms 7, thus dispensing with any need to break the linear continuity of the belt 13.

What is claimed:

1. A device serving to fashion carrying handles for attachment to sheet wrapping material, comprising:

infeed means supplying relatively narrow bulk strip from which single handles are formed;

cutting means with which to sever the bulk strip into discrete strips of given length;

punching means operated such that each discrete strip emerges with a pair of substantially C-shaped incisions disposed face to face;

support and feed means that convey the discrete strip through a rectilinear path above the level of the wrapping film;

means for retention of the two opposite ends of a discrete strip conveyed by the support and feed means, that are capable of movement parallel with and above the level of the support and feed means between at least two limit positions: a first, spread apart, in which the discrete strip with its two incisions is picked up, still lying flat; and a second, drawn together in such a way that the strip is folded and assumes an upturned-T profile with the two incisions sandwiched together;

positioning means, by which the retention means are carried, that are capable of movement between a retracted position, in which the retention means are in vertical alignment with the support and feed means and able to spread apart and draw together, and an extended position, in which the retention means are located outside the area occupied by the support and feed means and rendered capable of vertical movement between a raised limit position, in which the discrete strip is picked up from the support and feed means, and a lowered limit position in which the discrete strip is offered to the sheet wrapping material.

2. Device as in claim 1, comprising a fold former that occupies a position coincident with the median axis between the retention means, and is capable of vertical movement between a lowered position, in which it projects no higher than the level of the support and feed means, and a raised position in which it lies between the retention means when in their second limit position.

3. Device as in claim 1, wherein the retention means are carried by pairs of arms that are attached to the positioning means in such a way as to create two articulated parallelograms with the retention and the positioning means, and capable of rotating about respective vertical axes between a first limit position in which they are substantially in parallel alignment with the support and feed means, and a second limit position in which they are brought to lie substantially at right angles to the support and feed means, whereas the ends of the discrete strip move parallel with one another when drawn together.

4. Device as in claim 1, wherein the arms that carry the retention means are adjustable, and can be lengthened or shortened to match the length of the discrete strip.

5. Device as in claim 1, wherein the retention means are capable of vertical movement in relation to the positioning means by which they are carried.

6. Device as in claim 1, wherein the arms which carry the retention means are capable of movement along their respective axes of rotation in order to permit of moving the retention means between their raised and lowered positions.

7. Device as in claim 6, wherein the arms which carry the strip retention means are capable of simultaneous linear and rotary movement along and about their respective axes of rotation.

8. Device as in claim 1, wherein the positioning means are capable of movement on a level above the support and feed means and in a direction at right angles thereto, and carried by a structure capable of movement parallel with the support and feed means along at least one traverse rail.

9. Device as in claim 8, wherein the support and feed means are disposed at right angles to the feed direction of the wrapping film.

10. Device as in claim 1, wherein the means for retention of a discrete strip operate by suction.

11. Device as in claim 9, wherein the traverse rail is capable of reciprocating parallel with the feed direction of the wrapping film and at identical speed thereto, at least during attachment of the discrete strip to the film.

12. Device as in claim 9, comprising an immovable traverse rail positioned above the wrapping film and operating in conjunction with means located upstream and downstream of the device in relation to the feed direction of the film, the functions of which are to grip the film and to compensate for changes in feed conditions, respectively.

* * * * *